US012004559B2

(12) United States Patent
Rossi et al.

(10) Patent No.: US 12,004,559 B2
(45) Date of Patent: Jun. 11, 2024

(54) CIGAR HOLDER AND METHOD FOR MAKING SAME

(71) Applicant: CIGAR ASSIST, LLC, Hamburg, NY (US)

(72) Inventors: Louis Rossi, Hamburg, NY (US); Vince Sorbara, Depew, NY (US); Daniel O'Connell, Hamburg, NY (US); Joseph Donovan, Buffalo, NY (US)

(73) Assignee: CIGAR ASSIST, LLC, Hamburg, NY (US)

( * ) Notice: Subject to any disclaimer, the term of this patent is extended or adjusted under 35 U.S.C. 154(b) by 35 days.

(21) Appl. No.: 17/813,032

(22) Filed: Jul. 16, 2022

(65) Prior Publication Data

US 2023/0017077 A1 Jan. 19, 2023

Related U.S. Application Data

(60) Provisional application No. 63/203,302, filed on Jul. 16, 2021.

(51) Int. Cl.
*A24F 13/02* (2006.01)

(52) U.S. Cl.
CPC ..... *A24F 13/02* (2013.01)

(58) Field of Classification Search
CPC ..... A24F 13/02
See application file for complete search history.

(56) References Cited

U.S. PATENT DOCUMENTS 2,226,251 A 12/1940 Mayer
3,056,412 A 10/1962 Wolfe
(Continued)

FOREIGN PATENT DOCUMENTS

JP S51151340 U 12/1976
JP S5396488 U 8/1978
(Continued)

OTHER PUBLICATIONS

The Ninety Degree Wedge, Ninety Degree Wedge, https://web.archive.org/web/20210506125916/https://www.theninetydegree.com/the-ninety-degree, https://web.archive.org/web/20210506125916/https://www.theninetydegree.com/the-ninety-degree (Year: 2015).*
(Continued)

*Primary Examiner* — Russell E Sparks

(74) *Attorney, Agent, or Firm* — Mertzlufft Law PLLC; Joshua Mertzlufft

(57) ABSTRACT

A cigar holder may comprise a tubular receptacle having a sidewall, a first end, and a second end, the first end comprising a first opening such that the tubular receptacle may be configured to receive at least a portion of a cigar insertably thereinto via the first opening of the first end, the second end comprising a second opening, the sidewall of the tubular receptacle including a through-hole; a magnet receptacle fastened to the second end of the tubular receptacle, the magnet receptacle comprising an end cap and a protrusion extending therefrom, the protrusion fit to the second opening, the protrusion including a cavity; and a magnet disposed at least partially within the cavity. A method of making a cigar holder may comprise providing a tubular receptacle, a magnet receptacle, and a magnet; attaching the magnet to the magnet receptacle; and fastening the magnet receptacle to the tubular receptacle.

20 Claims, 11 Drawing Sheets

(56) References Cited

U.S. PATENT DOCUMENTS

| | | | | |
|---|---|---|---|---|
| 6,460,239 | B2 * | 10/2002 | Newman | A63C 9/00 324/67 |
| 10,004,257 | B2 | 6/2018 | Zilka | |
| 10,017,089 | B2 | 7/2018 | Wallace et al. | |
| 10,688,900 | B2 | 6/2020 | Allen | |
| 2007/0000133 | A1 * | 1/2007 | Kasuli | A24F 13/26 30/113 |
| 2007/0251534 | A1 | 11/2007 | Raybum | |
| 2015/0164137 | A1 | 6/2015 | Shields | |
| 2020/0391641 | A1 | 12/2020 | Tung | |

FOREIGN PATENT DOCUMENTS

| | | | |
|---|---|---|---|
| JP | H09234051 | A | 9/1997 |
| WO | WO2015004602 | A2 | 1/2015 |

OTHER PUBLICATIONS

Cigarandrum, The Ninety Degree Wedge, (Last Accessed Jul. 14, 2022 at 4:08 P.M.), https://www.theninetydegree.com/.

* cited by examiner

CIGAR HOLDER AND METHOD FOR MAKING SAME

CROSS REFERENCE TO RELATED APPLICATIONS

This application claims priority to U.S. Provisional Application No. 63/203,302, filed on 16 Jul. 2021, the entire disclosure of which is hereby incorporated by reference.

BACKGROUND

Many people, including golfers, smoke cigars while engaged in recreational activities. There is a need for an effective, simple, and safe manner to stow a lit cigar while not being smoked.

SUMMARY

This Summary is intended to introduce, in an abbreviated form, various topics to be elaborated upon below in the Detailed Description. This Summary is not intended to identify key or essential aspects of the claimed invention. This Summary is similarly not intended for use as an aid in determining the scope of the claims.

In some aspects, the techniques described herein relate to a cigar holder, including: a tubular receptacle having a sidewall, a first end, and a second end, the first end including a first opening such that the tubular receptacle is configured to receive at least a portion of a cigar insertably thereinto via the first opening of the first end, the second end including a second opening, the sidewall of the tubular receptacle further defined by a through-hole; a magnet receptacle fastened to the second end of the tubular receptacle, the magnet receptacle including an end cap and a protrusion extending therefrom, the protrusion configured to fit to the second end such that the magnet receptacle is attached to the tubular receptacle proximate the second end, the protrusion and end cap defining a cavity; and a magnet disposed on the end cap at least partially within the cavity; wherein the second end includes a first thread and the protrusion includes a second thread, wherein the protrusion is configured to fit to the second end via a threaded connection including the first thread and the second thread; wherein the first thread is disposed about an exterior surface of the tubular receptacle proximate the second end and the second thread is disposed about an interior surface of the protrusion; and wherein the through-hole has a hole diameter equal to or greater than a shaft diameter of a golf tee.

In some aspects, the techniques described herein relate to a cigar holder, wherein the diameter of the through-hole is smaller than a diameter of a head of the golf tee.

In some aspects, the techniques described herein relate to a cigar holder, wherein a longitudinal axis of the through-hole is coincident with a normal axis of the first opening.

In some aspects, the techniques described herein relate to a cigar holder, wherein a normal axis of the first opening is at a right angle to a normal axis of the second opening.

In some aspects, the techniques described herein relate to a cigar holder, including: a tubular receptacle having a sidewall, a first end, and a second end, the first end including a first opening such that the tubular receptacle is configured to receive at least a portion of a cigar insertably thereinto via the first opening of the first end, the second end including a second opening, the sidewall of the tubular receptacle further defined by a through-hole; a magnet receptacle fastened to the second end of the tubular receptacle, the magnet receptacle including an end cap and a protrusion extending therefrom, the protrusion configured to fit to the second end such that the magnet receptacle is attached to the tubular receptacle proximate the second end, the protrusion and end cap defining a cavity; and a magnet disposed on the end cap at least partially within the cavity.

In some aspects, the techniques described herein relate to a cigar holder, wherein the second end includes a first thread and the protrusion includes a second thread, wherein the protrusion is configured to fit to the second end via a threaded connection including the first thread and the second thread.

In some aspects, the techniques described herein relate to a cigar holder, wherein the first thread is disposed about an exterior surface of the tubular receptacle proximate the second end and the second thread is disposed about an interior surface of the protrusion.

In some aspects, the techniques described herein relate to a cigar holder, wherein the first thread is disposed about an interior surface of the tubular receptacle proximate the second end and the second thread is disposed about an exterior surface of the protrusion.

In some aspects, the techniques described herein relate to a cigar holder, wherein the protrusion is configured to be insertably fit into the second end, thereby fitting the protrusion to the second end.

In some aspects, the techniques described herein relate to a cigar holder, wherein the through-hole has a diameter sufficiently large to permit passage of a shaft of a golf tee.

In some aspects, the techniques described herein relate to a cigar holder, wherein the diameter of the through-hole is smaller than a diameter of a head of the golf tee.

In some aspects, the techniques described herein relate to a cigar holder, wherein the through-hole has a diameter sufficiently large to permit passage of a shaft of a piston therethrough.

In some aspects, the techniques described herein relate to a cigar holder, wherein the diameter of the through-hole is smaller than a diameter of a head of the piston.

In some aspects, the techniques described herein relate to a cigar holder, wherein the magnet includes a hard magnet or a soft magnet.

In some aspects, the techniques described herein relate to a cigar holder, wherein the magnet includes an aluminum-nickel-cobalt magnet, a samarium cobalt magnet, a ferrite magnet, a neodymium-iron-boron magnet, a neodymium-cobalt magnet, a silicon steel sheet magnet, or a soft core magnet.

In some aspects, the techniques described herein relate to a cigar holder, wherein the magnet has a magnetic strength sufficient to constrain an orientation of the magnet relative to an external object to which the cigar holder is attached via magnetic attraction between the magnet and the external object.

In some aspects, the techniques described herein relate to a cigar holder, wherein a normal axis of the first opening is at a right angle to a normal axis of the second opening.

In some aspects, the techniques described herein relate to a method of making a cigar holder, including: providing a tubular receptacle having a sidewall, a first end, and a second end, the first end including a first opening such that the tubular receptacle is configured to receive at least a portion of a cigar insertably thereinto via the first opening of the first end, the second end including a second opening, the sidewall of the tubular receptacle further defined by a through-hole; providing a magnet receptacle including an end cap and a protrusion extending therefrom, the protrusion defining a cavity; providing a magnet; attaching the magnet to the magnet receptacle such that the magnet is disposed on the end cap at least partially within the cavity; and fastening the magnet receptacle to the second end of the tubular receptacle such that the protrusion is insertably fit into the second opening of the second end.

In some aspects, the techniques described herein relate to a method, wherein the magnet has a magnetic strength sufficient to constrain an orientation of the magnet relative to an external object to which the cigar holder is attached via magnetic attraction between the magnet and the external object.

In some aspects, the techniques described herein relate to a method, wherein the first opening is disposed at a right angle, an obtuse angle, or an acute angle relative to the second opening.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION

Figure 1A:
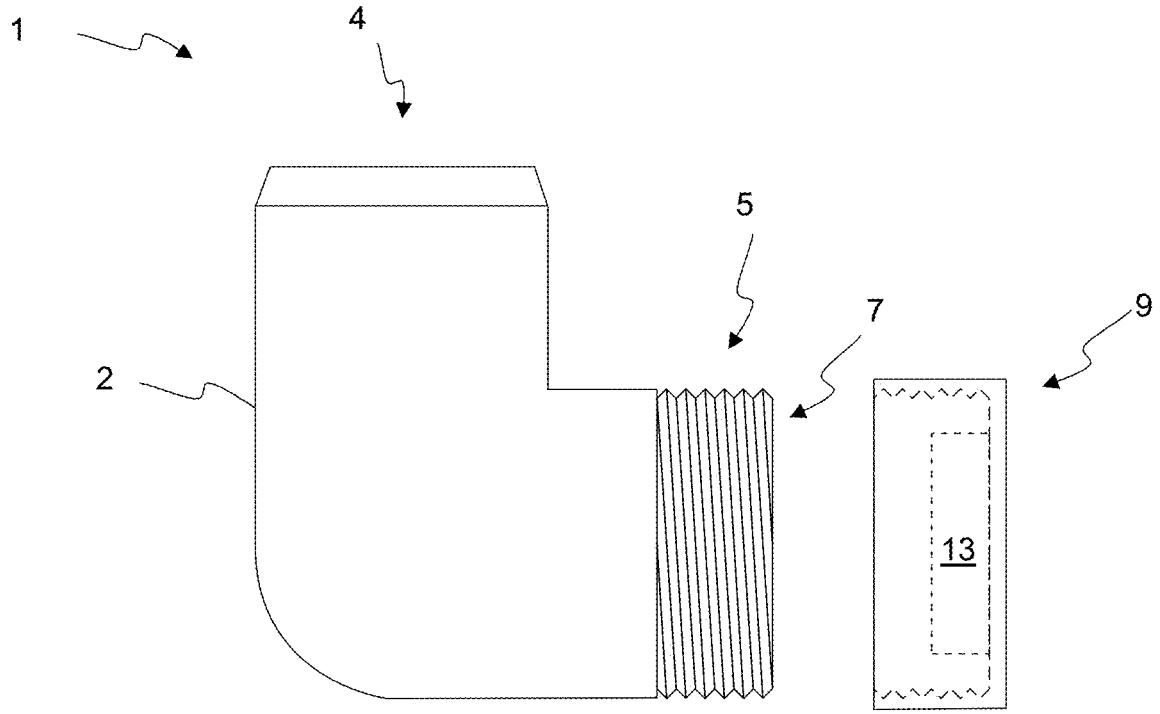
FIG. 1A illustrates a cigar holder according to some implementations.

It is to be understood that the invention is not limited in its application to the details of construction and the arrangements of components and/or method steps set forth in the following description or illustrated in the drawings, and phraseology and terminology used herein is for the purpose of description and should not be regarded as limiting. The invention is capable of other embodiments and implementations and of being practiced or being carried out in various ways. Accordingly, other aspects, advantages, and modifications will be apparent to those skilled in the art to which the invention pertains, and these aspects and modifications are within the scope of the invention, which is limited only by the appended claims.

Many people, including golfers, smoke cigars while engaged in recreational activities. When engaging in such activities outdoors, a smoker may need to stow a lit cigar when not being smoked. Oftentimes, smokers place a cigar in an unintended and/or ineffective receptacle, on the ground, or in a clamp or horizontal-type stowage device. When a cigar is stowed in an unsafe manner, it may pose danger of fire or burns. Furthermore, such methods of stowing a cigar can result in uneven burn of the cigar, and may degrade its integrity, longevity, and/or taste.

While the generalized cigar smoker may face such problems, the problems are exacerbated for golfers who wish to smoke a cigar while playing a round of golf. On a golf course, a golfer is often limited to a golf cart for the stowage of personal effects as frequent relocation is required. It would be impractical to return to a fixed location on the golf course each time a golfer wishes to take up or stow a lit cigar.

Thus, there is a need for an effective, simple, and safe manner to stow a lit cigar while not being smoked.

Implementations disclosed herein include cigar holders and methods of making and using the same.

Implementations may include a cigar holder. Implementations may present an effective, simple, and/or safe manner to stow a lit cigar while not being smoked. An implementation cigar holder may be configured for mounting on a particular surface, and as such angles of components may be determined at the time of manufacture to hold a cigar substantially vertically when later used.

Figure 1B:
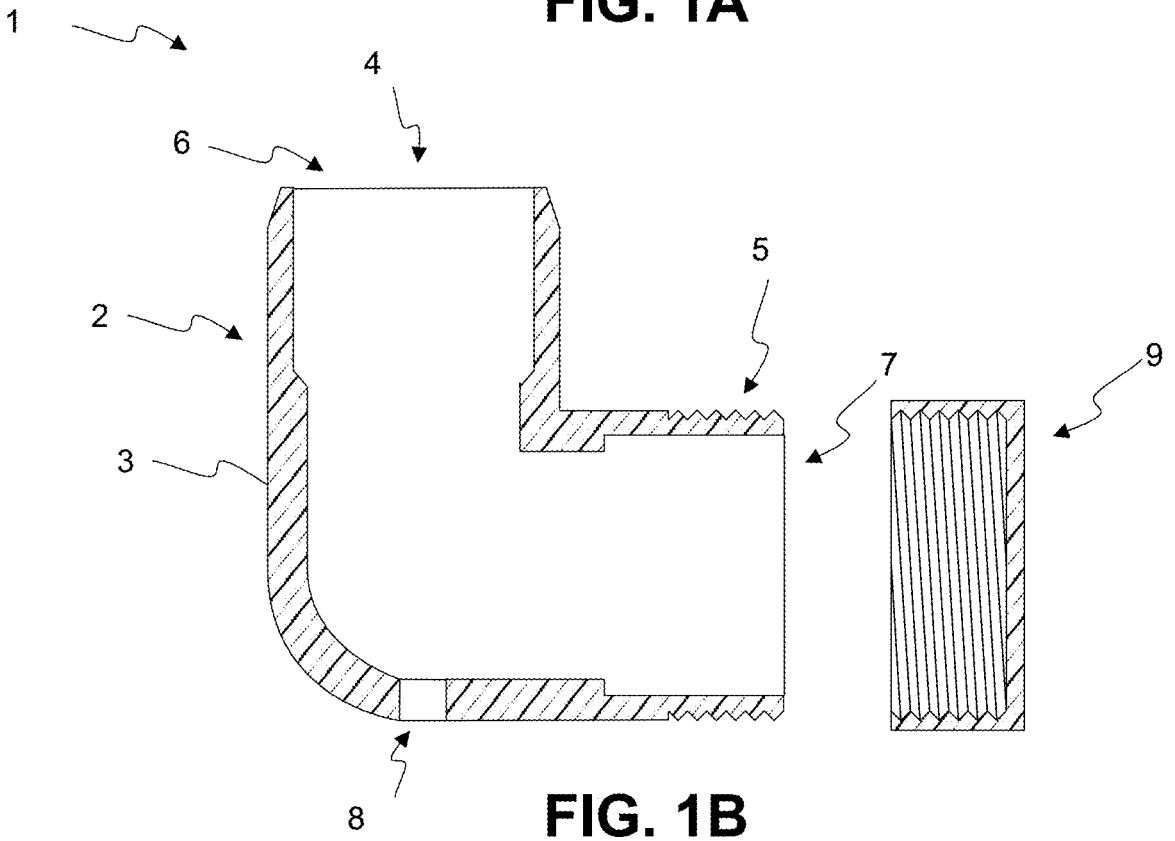
FIG. 1B illustrates a cross-section of the cigar holder of FIG. 1A, according to some implementations.

In some implementations, with reference to FIGS. 1A and 1B, a cigar holder 1 may comprise a tubular receptacle 2, a magnet receptacle 9, and a magnet 13. FIG. 1B may illustrate a cross-section of cigar holder 1 depicted in FIG. 1A. Tubular receptacle 2 may include a through-hole 8 and a first opening 6. Tubular receptacle 2 may have a sidewall 3. Tubular receptacle 2 may have a first end 4 and a second end 5. First end 4 may comprise first opening 6 and second end 5 may comprise a second opening 7. Tubular receptacle 2 may comprise various forms of a tubular structure. For example, tubular receptacle 2 may comprise a circular tube, an elliptical tube, a rectangular tube, a square tube, or a tube having an irregular profile.

The profile of tubular receptacle 2 need not be the same over the length of the tubular receptacle. For instance, tubular receptacle 2 may have a profile of a larger-area cross-section at second end 5 than at first end 4. In some implementations, tubular receptacle 2 may be monolithic. In other implementations, tubular receptacle 2 may be an assembly of sub-components. Such sub-components may be attached to each other, for example, using an adhesive, welding, a fitted joint, or other style of joint or means of attachment.

Sidewall 3 of tubular receptacle 2 may include through-hole 8. Through-hole 8 may have a sufficiently large diameter to permit passage of a shaft (e.g., a golf tee shaft or a piston shaft) therethrough. Through-hole 8 may be positioned at various locations on tubular receptacle 2. The shaft may be that of a golf tee or that of a piston, which will be discussed further below. Alternatively, the shaft may be that of another implement, such as a pencil or pen and the through-hole may be sized accordingly. The diameter of through-hole 8 may be sized smaller than a diameter of a head of a golf tee or a head of a piston, which will be discussed further below. In some implementations, through-hole 8 may also serve as a drain. In such implementations, through-hole 8 may be sized and positioned to enable passage of fluid out of the tubular receptacle 2.

Figure 2A:
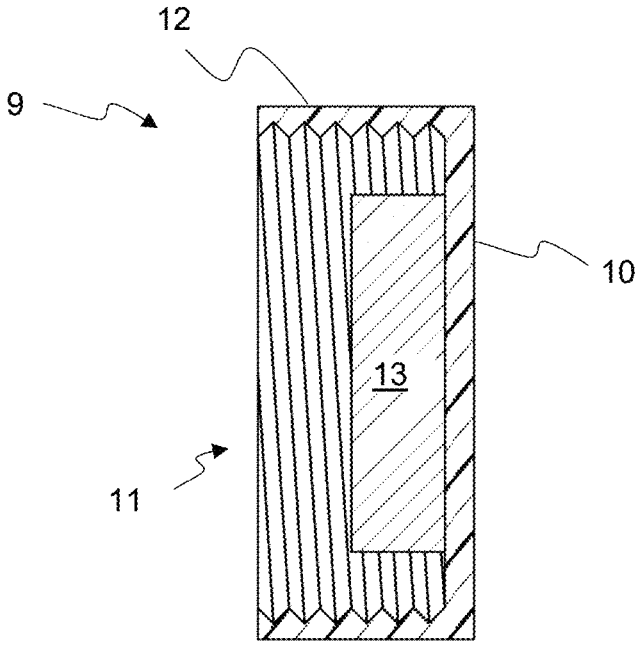
FIG. 2A illustrates a magnet receptacle according to some implementations.
Figure 2B:
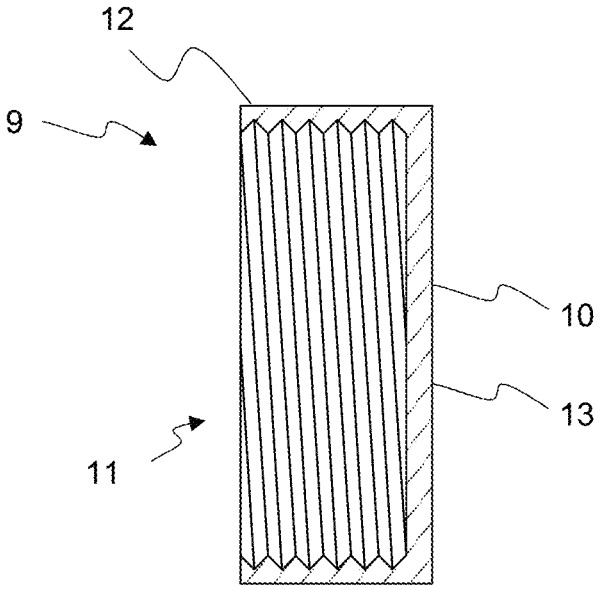
FIG. 2B illustrates an integrally-magnetic magnet receptacle according to some implementations.

With reference to FIGS. 2A and 2B, magnet receptacle 9 may comprise an end cap 10 and a protrusion 12. Protrusion 12 may extend from end cap 10. Protrusion 12 and end cap 10 may define a cavity 11. End cap 10 may be of a similar shape to the cross section of tubular receptacle 2. For example, if sidewall 3 of tubular receptacle 2 has a circular profile, and may thus be classified as a circular tube, end cap 10 may have a substantially similar circular profile, although the diameters of end cap 10 and tubular receptacle 2 may be different.

Protrusion 12 may comprise a single protrusion. Protrusion 12 may comprise the same material as end cap 10 and may be monolithic or integral to it to compose magnet receptacle 9.

Magnet receptacle 9 may be fastened to second end 5 of the tubular receptacle 2 via a threaded connection, with a first thread disposed about second end 5 and a second thread disposed about protrusion 12. To effect fastening of magnet receptacle 9 to second end 5 of tubular receptacle 2, protrusion 12 may be screwed onto second end 5. In some instances, the first thread disposed about second end 5 may compose the female (e.g., having threads disposed about its interior) or male (e.g., having threads disposed about its exterior) portion of a threaded connection between second end 5 and magnet receptacle 9, and the second thread disposed about protrusion 12 may compose the other of the female or male portion of the threaded connection between second end 5 and magnet receptacle 9.

In some implementations, magnet 13 may be affixed to the interior of magnet receptacle 9. In some further implementations, magnet 13 may be integral to magnet receptacle 9 (e.g., magnet 13 may be embedded in magnet receptacle 9, or magnet receptacle 9 may be magnetized or otherwise a magnetic material).

Figure 3A:
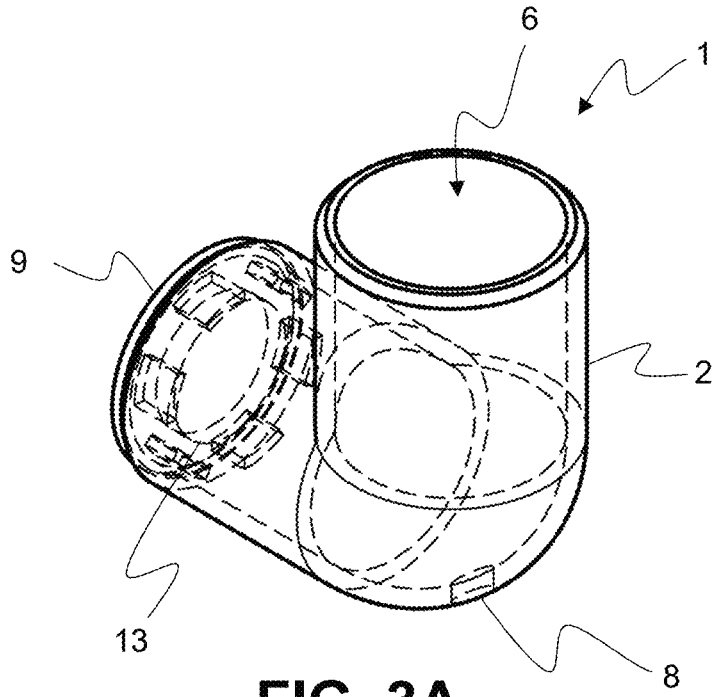
FIGS. 3A and 3B illustrate an isometric view and a side view, respectively, of a cigar holder according to some implementations.
Figure 3B:
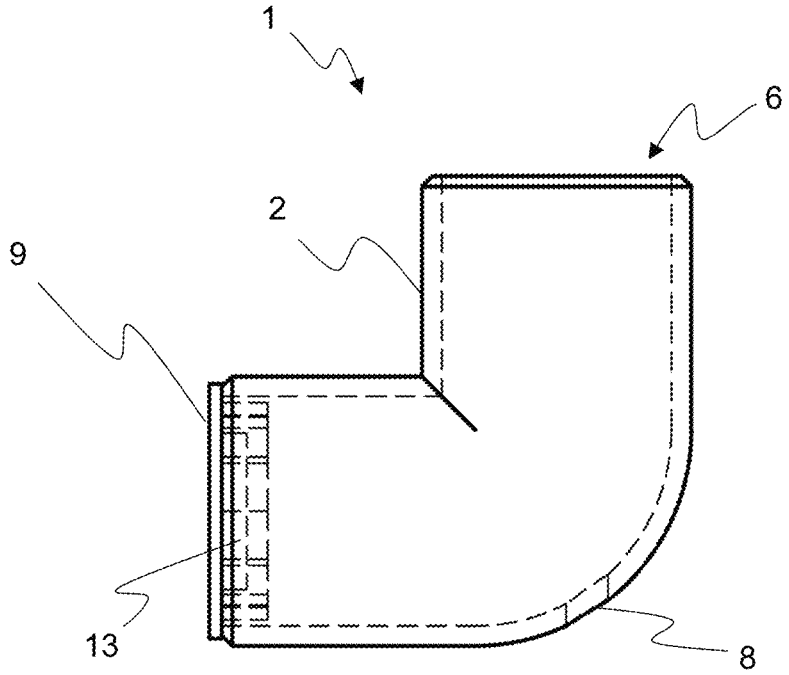

In other implementations, with reference to FIGS. 3A and 3B, a cigar holder 1 may comprise a tubular receptacle 2, a magnet receptacle 9, and a magnet 13. Tubular receptacle 2 may include a through-hole 8 and a first opening 6.

Figure 4A:
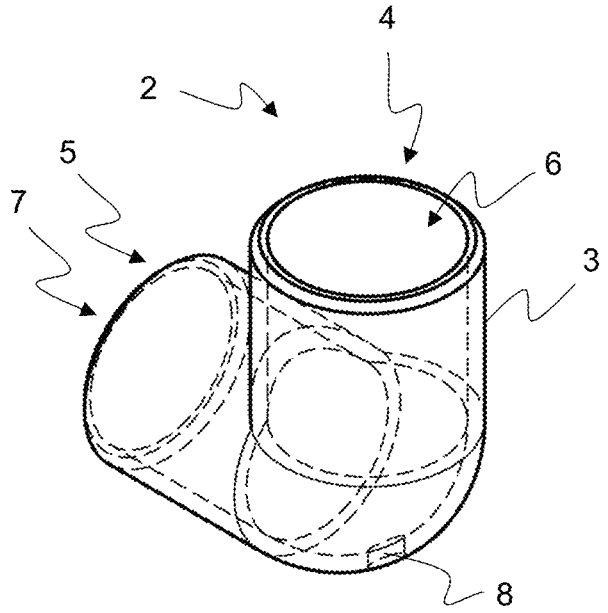
FIGS. 4A and 4B illustrate an isometric view and a side view, respectively, of a tube receptacle according to some implementations.
Figure 4B:
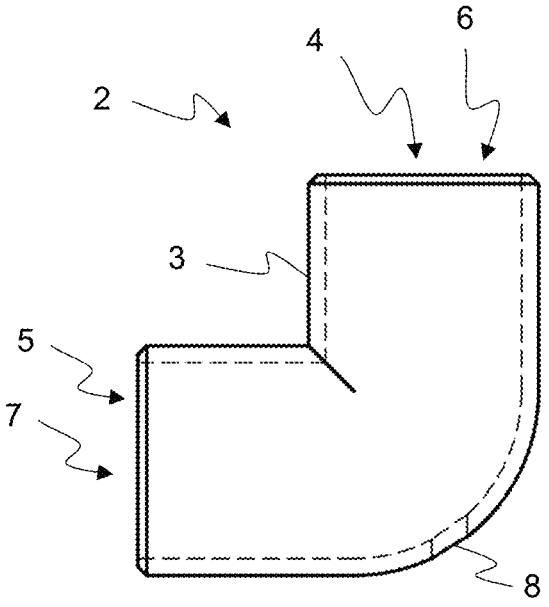

With reference to FIGS. 4A and 4B, tubular receptacle 2 may have a sidewall 3. Tubular receptacle 2 may have a first end 4 and a second end 5. First end 4 may comprise first opening 6 and second end 5 may comprise a second opening 7. Tubular receptacle 2 may comprise various forms of a tubular structure. For example, tubular receptacle 2 may comprise a circular tube, an elliptical tube, a rectangular tube, a square tube, or a tube having an irregular profile.

Sidewall 3 of tubular receptacle 2 may include through-hole 8. Through-hole 8 may have a sufficiently large diameter to permit passage of a shaft therethrough. Through-hole 8 may be positioned at various locations on tubular receptacle 2. The shaft may be that of a golf tee or that of a piston, which will be discussed further below. Alternatively, the shaft may be that of another implement, such as a pencil or pen and the through-hole may be sized accordingly. The diameter of through-hole 8 may be sized smaller than a diameter of a head of a golf tee or a head of a piston, which will be discussed further below. In some implementations, through-hole 8 may also serve as a drain. In such implementations, through-hole 8 may be sized and positioned to enable the passage of fluid out of the tubular receptacle 2.

Figure 5A:
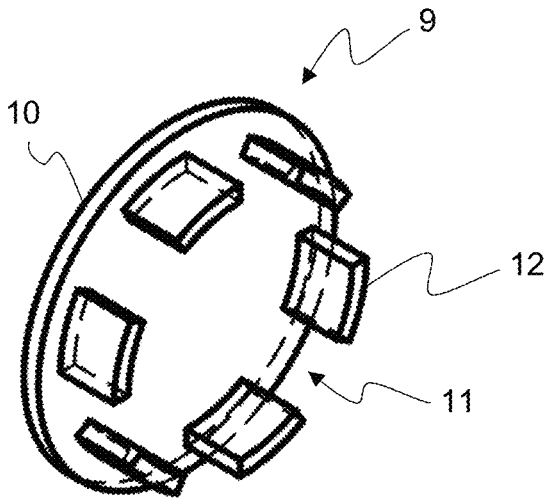
FIGS. 5A and 5B illustrate an isometric view and a side view, respectively, of a magnet receptacle according to some implementations.
Figure 5B:
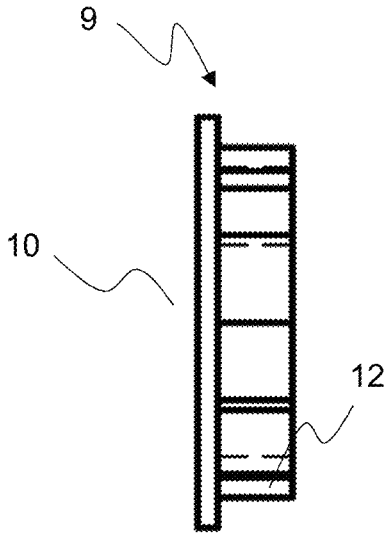

With reference to FIGS. 5A and 5B, magnet receptacle 9 may be comprise an end cap 10 and a protrusion 12. Protrusion 12 may extend from end cap 10. Protrusion 12 and end cap 10 may define a cavity 11. End cap 10 may be of a similar shape to the cross section of tubular receptacle 2. In this way, the outer boundary of end cap 10 may be smaller than or substantially flush with the outer boundary of sidewall 3 of tubular receptacle 2 when end cap 10 is fastened to second end 5 of tubular receptacle 2. For example, if sidewall 3 of tubular receptacle 2 has a circular profile, and may thus be classified as a circular tube, end cap 10 may have a substantially similar circular profile having a substantially similar outer diameter to that of sidewall 3 of tubular receptacle 2.

Protrusion 12 may comprise a single protrusion or multiple protrusions. For example, FIGS. 5A and 5B illustrate six individual protrusions composing protrusion 12. Protrusion 12 may comprise the same material as end cap 10 and may be monolithic or integral to it to compose magnet receptacle 9. Protrusion 12 may alternately be assembled to end cap 10 to compose magnet receptacle 9.

Figure 6A:
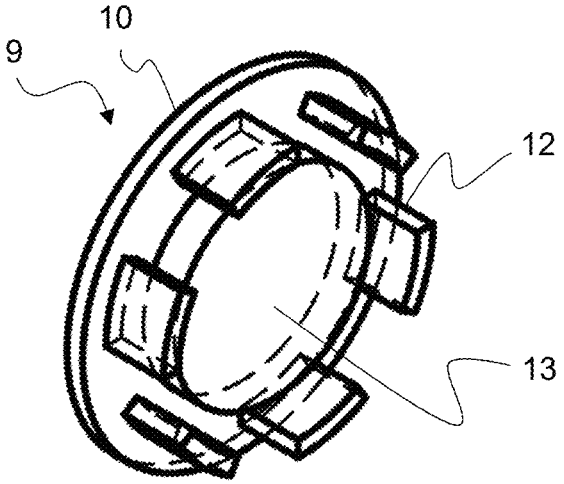
FIGS. 6A and 6B illustrate an isometric view and a side view, respectively, of a magnet affixed to a magnet receptacle according to some implementations.
Figure 6B:
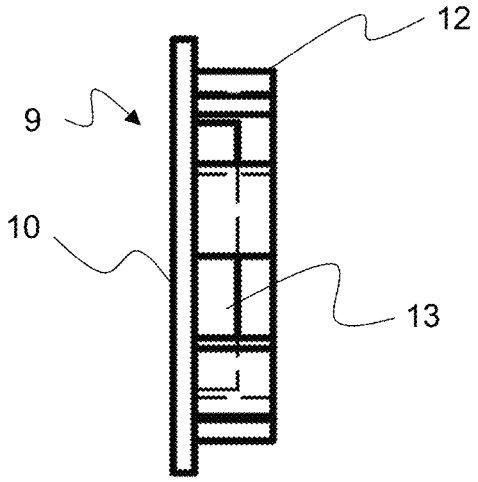

Magnet receptacle 9 may be fastened to second end 5 of the tubular receptacle 2 as depicted in FIGS. 6A and 6B. To effect fastening of magnet receptacle 9 to second end 5 of tubular receptacle 2, protrusion 12 may be insertably fit into second opening 7 of second end 5.

Protrusion 12 may be configured such that it has a profile configured to fasten to tubular receptacle 2 by fitting into second opening 7 of second end 5 of tubular receptacle 2, as depicted, for example, in FIGS. 3A and 3B. This fit may be a press-fit, an interference fit, a shrink-fit, or another mechanical fit. For example, protrusion 12 may include a nib configured to fit into one or more channels of tubular receptacle 2 proximate second end 5. In other implementations, protrusion 12 may have a threaded outer diameter, configured to be fastened to a corresponding thread on the inner diameter of tubular receptacle 2 proximate second end 5.

Magnet 13 may have a geometry configured to fit at least partially within cavity 11. For example, in an implementation having a circular cavity 11, magnet 13 may also be circular and have an outer diameter configured to fit into circular cavity 11. In another example implementation, where cavity 11 has a rectangular profile, magnet 13 may also have a rectangular profile of dimensions configured to fit into cavity 11. In yet another example implementation, where cavity 11 has an irregular profile, magnet 13 may also have an irregular profile configured to fit into cavity 11. Accordingly, magnet 13 may be disposed at least partially within cavity 11 bounded by protrusions 12 of magnet receptacle 9. Magnet 13 may be attached to magnet receptacle 9 by, for example, an adhesive.

Magnet 13 may be a hard magnet. For example, a hard magnet may be an aluminum-nickel-cobalt, samarium cobalt, ferrite, neodymium-iron-boron, or neodymium-cobalt magnet. Magnet 13 may be a soft magnet. For example, a soft magnet may be a silicon steel sheet or soft-core magnet. Magnet 13 may have a magnetic strength sufficient to constrain an orientation of magnet 13 relative to an external object to which the cigar holder is attached via attraction between magnet 13 and the external object.

Tubular receptacle 2 of cigar holder 1 may be of a geometry configured to provide for substantially vertical stowage of a cigar in various implementation applications.

Figure 7A:
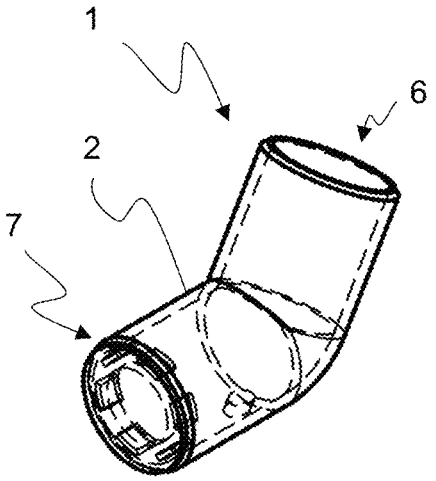
FIGS. 7A and 7B illustrate an isometric view and a side view, respectively, of a cigar holder according to some implementations.
Figure 7B:
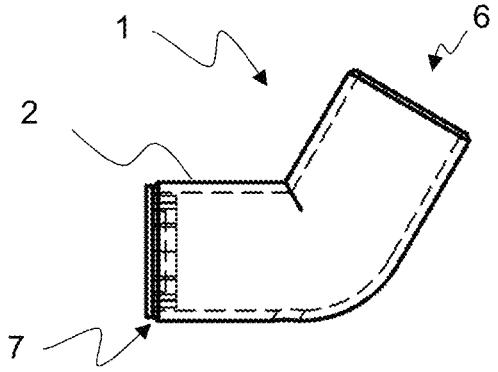
Figure 8A:
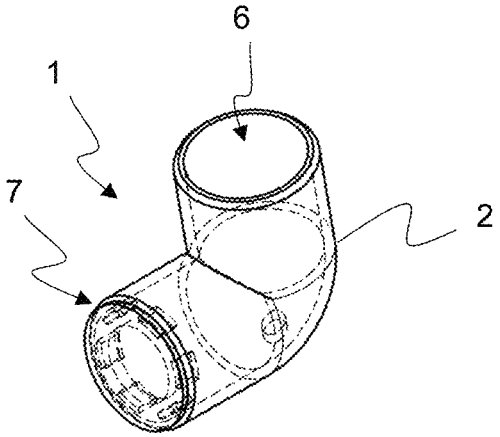
FIGS. 8A and 8B illustrate an isometric view and a side view, respectively, of a cigar holder according to some implementations.
Figure 8B:
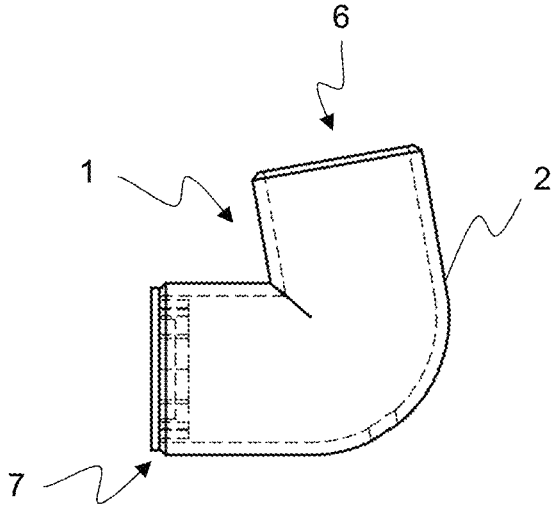

In this way, first opening 6 may be disposed at a right angle (as illustrated, for example, in FIGS. 3A and 3B), at an obtuse angle (as illustrated, for example, in FIGS. 7A and 7B), or an acute angle (as illustrated, for example, in FIGS. 8A and 8B), relative to second opening 7. In some implementations, this angle may be selected based on the intended use of a given implementation.

Figure 9A:
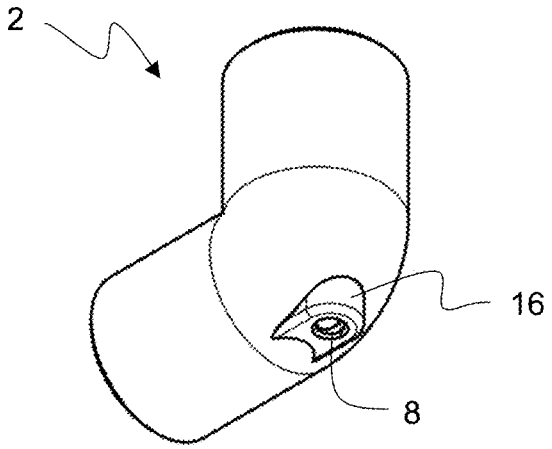
FIGS. 9A, 9B, and 9C illustrate a cigar holder having a through-hole boss according to some implementations.
Figure 9B:
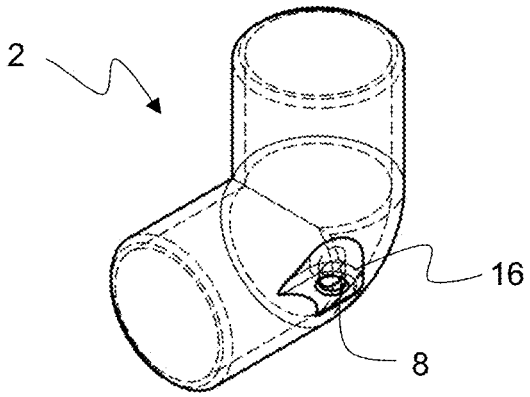
Figure 9C:
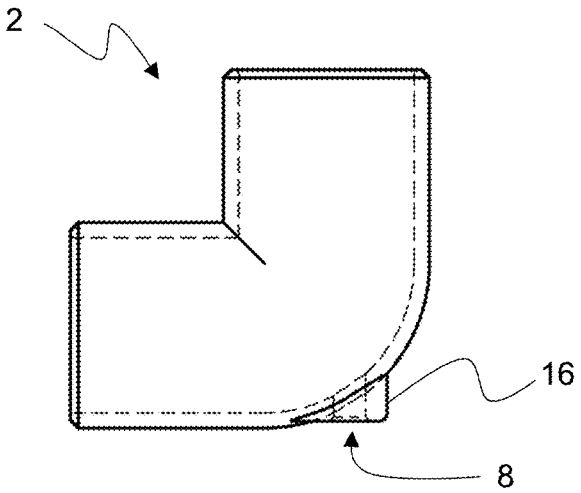

With reference to FIGS. 9A, 9B, and 9C, tubular receptacle 2 may include a boss 16 proximate through-hole 8. Boss 16 may provide additional structural integrity to tubular receptacle 2, as well as provide additional longitudinal length of through-hole 8. Such additional longitudinal length of through-hole 8 may be desirable in some implementations where through-hole 8 receives a shaft such that the shaft is held in place by its fit into through-hole 8. Boss 16 may be monolithic or integral with tubular receptacle 2 and may be formed of the same material as tubular receptacle 2. Boss 16 may further provide for the ability of cigar holder 1 to maintain an upright position (e.g., equilibrium to prevent tipping) when placed on a surface. In this way, if ashes or another substance is in tubular receptacle 2, boss 16 may prevent cigar holder 1 from tipping when set on a surface and thus prevent spillage of contents of tubular receptacle 2. Boss 16 may further be magnetic or otherwise comprise a magnet and so enable cigar holder 1 to be alternately affixed to a substantially horizontal (e.g., having an angle in relation to a radius of the earth of, for example, between 0 degrees and 60 degrees) surface (e.g., a horizontal member of the golf cart, the golf cart's body, another accessory, or a table).

In various implementations, tubular receptacle 2 may comprise a material of sufficient rigidity and melting point to maintain structural integrity when receiving a cigar and/or the ashes from the cigar. For example, tubular receptacle 2 may comprise plastic (e.g., ABS, polylactic acid (PLA), polycarbonate (PG), polyethylene terephthalate (PET, PETT, PETG, PETE), nylon, high density polyethylene (HDPE), polyvinyl chloride (PVC), low density polyethylene (LDPE), polypropylene (PP), or polystyrene, or other suitable plastics), metal (e.g., aluminum, steel, copper, alloys, or other suitable metal alloys), or another suitable material.

In various implementations, magnet receptacle 9 may comprise a material of sufficient rigidity and melting point to maintain structural integrity when receiving magnet 13 and/or coming into contact with ashes from a cigar. For example, magnet receptacle 9 may comprise plastic (e.g., ABS, polylactic acid (PLA), polycarbonate (PG), polyethylene terephthalate (PET, PETT, PETG, PETE), high density polyethylene (HDPE), polyvinyl chloride (PVC), nylon, low density polyethylene (LDPE), polypropylene (PP), or polystyrene, or other suitable plastics), metal (e.g., aluminum, steel, copper, alloys, or other suitable metal alloys), or another suitable material.

In various implementations, tubular receptacle 2 may have a circular profile and have an overall length of approximately 2.25 in (e.g., 57 mm), an overall height of approximately 2.25 in. (e.g., 57 mm), and comprise a circular tube having an outer diameter of approximately 1.29 in (e.g., 33 mm) and an inner diameter of approximately 1.1 in (e.g., 27 mm). An inner portion of tubular receptacle 2 may have an inner diameter of approximately 0.97 in. (e.g., 24.8 mm).

In various implementations, magnet receptacle 9 may have a circular profile and have an overall length of approximately 0.53 in (e.g., 13.5 mm) and an outer diameter of approximately 1.29 in (e.g., 33 mm).

In various implementations, end cap 10 of magnet receptacle 9 may have a circular profile and have an overall length of approximately 0.06 in (e.g., 1.5 mm) and an outer diameter of approximately 1.22 in (e.g., 31 mm).

In various implementations, protrusion 12 may comprise six individual protrusions spaced on an approximately 1.04 in (e.g., 26.42 mm) diameter circular pattern sharing a central axis with end cap 10. For example, each individual protrusion may have an arc chord length of approximately 0.27 in (e.g., 6.86 mm) and protrude from end cap 10 approximately 0.22 in (e.g., 5.59 mm).

In various implementations, through-hole 8 may have a diameter of approximately 0.219 in (e.g., 5.56 mm) and may be centered on a central axis of through-hole 6. In another example, through-hole 8 may be located on sidewall 3 approximately 1.75 in from second end 5.

In various implementations, magnet 13 may have a circular profile and may have a diameter of approximately 0.75 in (e.g., 19.05 mm) and a longitudinal thickness of approximately 0.12 in (e.g., 3.05 mm) to approximately 0.25 in (e.g., 6.36 mm).

Figure 10:
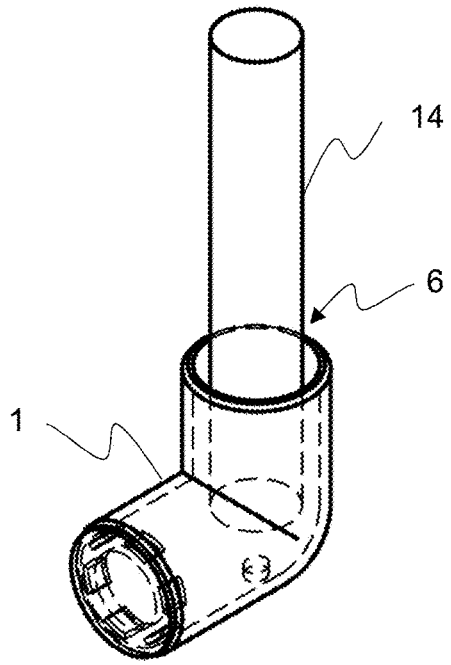
FIG. 10 illustrates a cigar holder according to some implementations holding a cigar.

In use, with reference to FIG. 10, implementations of cigar holder 1 may be configured to receive at least a portion of a cigar, for example a cigar 14, via first opening 6. In such implementations, a portion of cigar 14 may be inserted through first opening 6 of first end 4 into tubular receptacle 2. To accommodate receiving cigar 14 insertably thereinto, first opening 6 may have a sufficient inner area to permit passage of cigar 14 therethrough.

Figure 11:
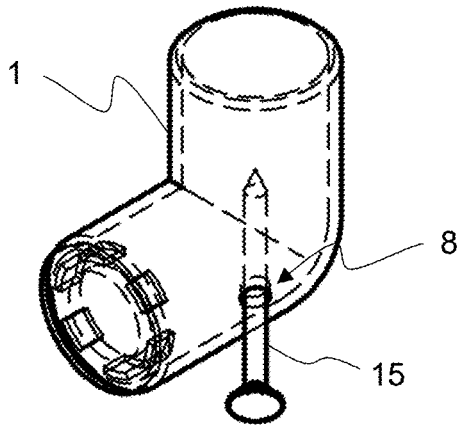
FIG. 11 illustrates a cigar holder according to some implementations having a golf tee inserted through a through-hole.

With reference to FIG. 11, in use of various implementations of cigar holder 1, an object 15 may be inserted through through-hole 8. Object 15 may be, for example, a golf tee or a piston. Object 15 may be inserted through through-hole in the direction of the interior of tubular receptacle 2 or in the direction of the exterior of tubular receptacle 2.

Figure 12A:
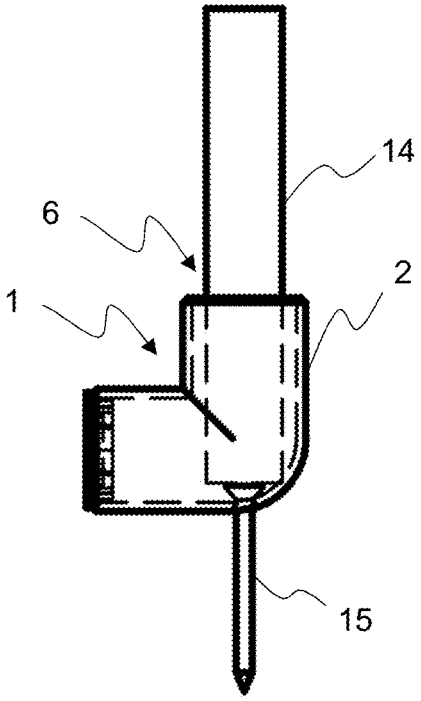
FIGS. 12A, 12B, and 12C illustrate a cigar holder according to some implementations having a cigar held and golf tee inserted through a through-hole at various positions.
Figure 12B:
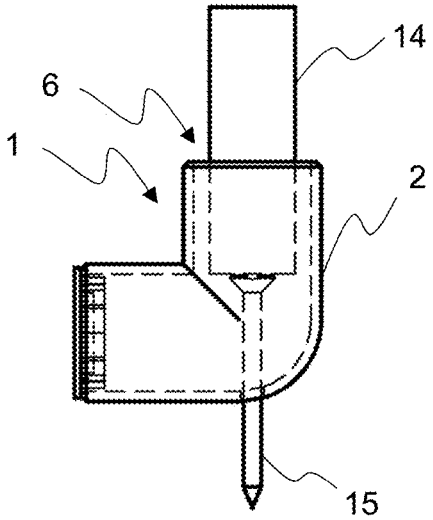
Figure 12C:
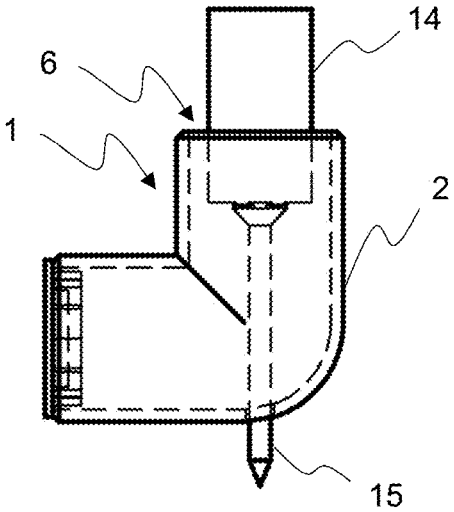

With reference to FIGS. 12A, 12B, and 12C, object 15 may be inserted through through-hole 8 and may be disposed at varying positions depending on how far through through-hole 8 object 15 has been inserted. To this effect, object 15 may provide a lower resting surface for a cigar, such as cigar 14, inserted into first opening 6 of cigar holder 1. In this way, object 15 may bound the extent to which cigar 14 may be inserted through first opening 6 into tubular receptacle 2 of cigar holder 1.

As a non-limiting example of the foregoing, object 15 may be a golf tee inserted though through-hole 8 in the direction of the exterior of tubular receptacle 2. In a first example position depicted in FIG. 12A, object 15 may be inserted so far as permitted by its geometry through through-hole 8 toward the exterior of tubular receptacle 2 to provide a maximal distance between a head of object 15 to first opening 6. Thus, in FIG. 12A, when cigar 14 is inserted through first opening 6 into tubular receptacle 2, an initial inserted length of the cigar may be disposed within the tubular receptacle. As cigar 14 burns, cigar 14 becomes shorter, and the user of cigar holder 1 may need to ensure a continued ability to take hold of cigar 14 to remove it from tubular receptacle 2. FIGS. 12B and 12C illustrate two further example positions of object 15 to provide for an additional accessible portion of cigar 14 outside of the tubular receptacle 2. To effect these additional positions, object 15 may be pushed back through through-hole 8 toward the interior of tubular receptacle to the desired or optimal distance from the head of object 15 to first opening 6. This distance may be determined based on how much of cigar 14 may be disposed within tubular cavity 2 to stow cigar 14 using cigar holder 1, as well as based on how much of cigar 14 may be exposed external to opening 6 to be accessible by a user.

In some implementations, object 15 may be a piston. Such a piston may include a head and a shaft, which may be monolithic or integral to each other, and the head of object 15 may be disposed within tubular receptacle 2 and the shaft of the piston may be disposed at least partially within through-hole 8, to enable a user of the cigar holder to slide object 15 into and out of tubular receptacle 2 to control a distance from the head of object 15 to first opening 6.

Sidewall 3 of tubular receptacle 2 may have fastened or otherwise affixed thereto a means of displaying a quick-response (QR) code. The QR code may contain information calculated to, when scanned by an optical scanning device (e.g., a smartphone camera), provide a uniform resource link (URL) or other information. The URL or other information may be calculated based on the configuration or other attributes (e.g., size, color, orientation, etc.) of the tubular receptacle 2.

Figure 13:
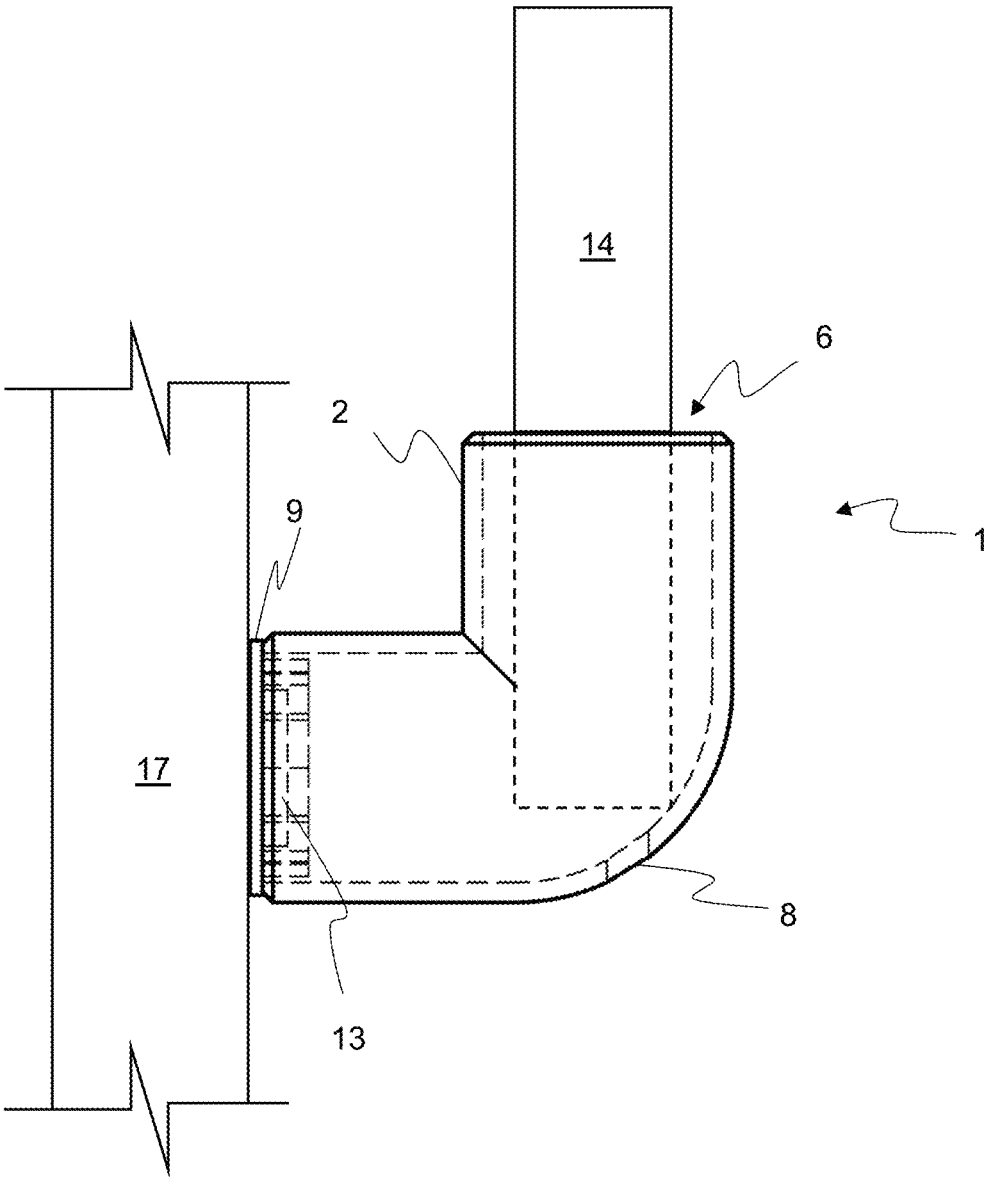
FIG. 13 illustrates a cigar holder according to some implementations attached to an external object.

In use, with reference to FIG. 13, cigar holder 1 may magnetically attach to an external object 17. To effect this, external object 17 may be metallic or otherwise susceptible to magnetic fields produced by magnet 13. In an example implementation, external object 17 may be a pillar of a golf cart. In such an implementation, a user may attach cigar holder 1 to the pillar of the golf cart in an orientation configured such that first opening 6 is located substantially upward (i.e., a normal axis of first opening 6 is oriented away from the ground). Thus, when a cigar, for example cigar 14, is inserted into cigar holder 1 via first opening 6, cigar 14 may be stowed in a substantially vertical position. Magnet 13 may be configured of sufficient magnetic strength to constrain cigar holder 1 from rotating relative to external object 17, thus providing a means to stow cigar 14 in a substantially vertical position, including when external object 17 is moved.

Figure 14:
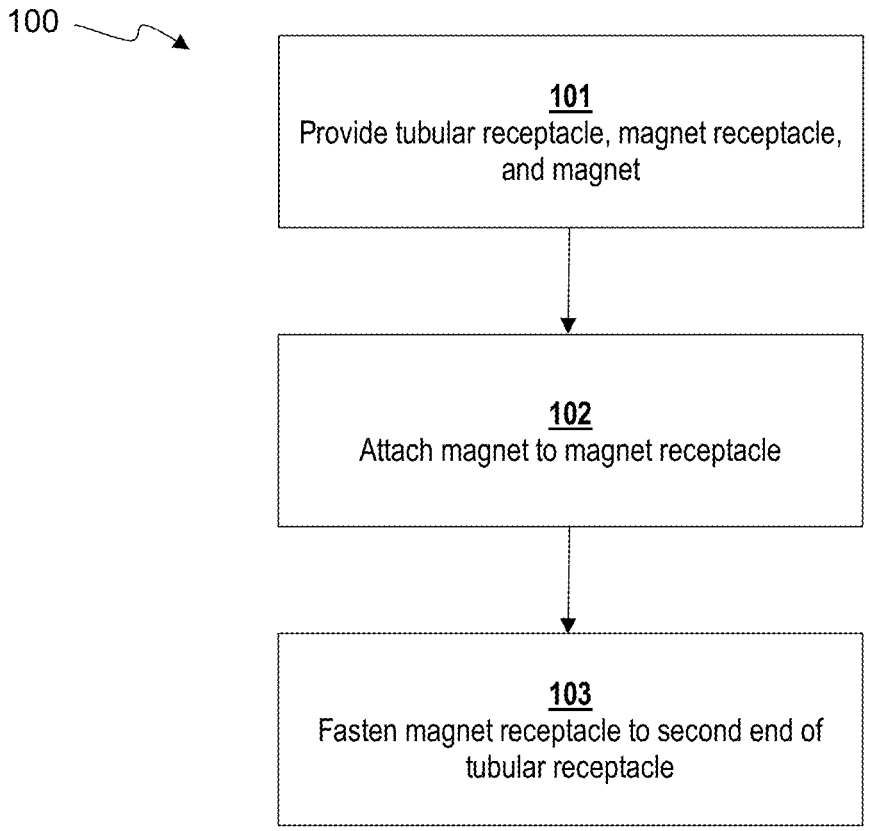
FIG. 14 illustrates a method of making a cigar holder according to some implementations.

Implementations may include a method of making a cigar holder. With reference to FIG. 14, a method 100 of making a cigar holder may comprise, at 101, providing a tubular receptacle, a magnet receptacle, and a magnet. Similar to the description relating to tubular receptacle 2 herein, the provided tubular receptacle may have a sidewall, a first end, and a second end, the first end comprising a first opening such that the tubular receptacle is configured to receive at least a portion of a cigar insertably thereinto via the first opening of the first end, the second end comprising a second opening, the sidewall of the tubular receptacle including a through-hole. Similar to the description relating to magnet receptacle 9 herein, the provided magnet receptacle may comprise an end cap and a protrusion extending therefrom, the protrusion including a cavity. The provided magnet may be described similarly to magnet 13.

Method 100 may further comprise, at 102, attaching the magnet to the magnet receptacle such that the magnet is disposed at least partially within the cavity.

Method 100 may further comprise, at 103, fastening the magnet receptacle to the second end of the tubular receptacle such that the protrusion is insertably fit into the second opening of the second end.

Various characteristics, advantages, embodiments, implementations, and/or examples relating to the invention have been described in the foregoing description with reference to the accompanying drawings. However, the above description and drawings are illustrative only. The invention is not limited to the illustrated embodiments and/or examples, and all embodiments and/or examples of the invention need not necessarily achieve every advantage or purpose, or possess every characteristic, identified herein. Accordingly, various changes, modifications, or omissions may be effected by one skilled in the art without departing from the scope or spirit of the invention, which is limited only by the appended claims. Although example materials and dimensions have been provided, the invention is not limited to such materials or dimensions unless specifically required by the language of a claim. Elements and uses of the above-described embodiments and/or examples can be rearranged and combined in manners other than specifically described above, with any and all permutations within the scope of the invention, as limited only by the appended claims.

In the claims, various portions are prefaced with letter or number references for convenience. However, use of such references does not imply a temporal or ordered relationship not otherwise required by the language of the claims. Unless the phrase 'means for' or 'step for' appears in a particular claim or claim limitation, such claim or sample claim limitation should not be interpreted to invoke 35 U.S.C. § 112(f).

As used in the specification and in the claims, use of "and" to join elements in a list forms a group of all elements of the list. For example, a list described as comprising A, B, and C defines a list that includes A, includes B, and includes C. As used in the specification and in the claims, use of "or" to join elements in a list forms a group of at least one element of the list. For example, a list described as comprising A, B, or C defines a list that may include A, may include B, may include C, may include any subset of A, B, and C, or may include A, B, and C. Unless otherwise stated, lists herein are inclusive, that is, lists are not limited to the stated elements and may be combined with other elements not specifically stated in a list. As used in the specification and in the claims, the singular form of 'a', 'an', and 'the' include plural referents (e.g., one or more of the referent) unless the context clearly dictates otherwise.

It is to be expressly understood that the drawings are for the purpose of illustration and description only and are not intended as a definition of the limits of the invention.

It is to be expressly understood that the drawings are for the purpose of illustration and description only and are not intended as a definition of the limits of the invention.

Unless otherwise stated, any range of values disclosed herein sets out a lower limit value and an upper limit value, and such ranges include all values and ranges between and including the limit values of the stated range, and all values and ranges substantially within the stated range as defined by the order of magnitude of the stated range.

The inventors hereby state their intent to rely on the Doctrine of Equivalents to determine and assess the reasonably fair scope of their invention as pertains to any apparatus not materially departing from but outside the literal scope of the invention as set out in the following claims.

We claim:

1. A cigar holder, comprising:

a tubular receptacle having a sidewall, a first end, and a second end, the first end comprising a first opening such that the tubular receptacle is configured to receive at least a portion of a cigar insertably thereinto via the first opening of the first end, the second end comprising a second opening, the sidewall of the tubular receptacle further defined by a through-hole;

a magnet receptacle fastened to the second end of the tubular receptacle, the magnet receptacle comprising an end cap and a protrusion extending therefrom, the protrusion configured to fit to the second end such that the magnet receptacle is attached to the tubular receptacle proximate the second end, the protrusion and the end cap defining a cavity;

a magnet disposed on the end cap at least partially within the cavity;

wherein the second end comprises a first thread and the protrusion comprises a second thread, wherein the protrusion is configured to fit to the second end via a threaded connection comprising the first thread and the second thread;

wherein the first thread is disposed about an exterior surface of the tubular receptacle proximate the second end and the second thread is disposed about an interior surface of the protrusion; and wherein the through-hole has a hole diameter equal to or greater than a shaft diameter of a golf tee.

2. The cigar holder of claim 1, wherein the diameter of the through-hole is smaller than a diameter of a head of the golf tee.

3. The cigar holder of claim 1, wherein a longitudinal axis of the through-hole is coincident with a normal axis of the first opening.

4. The cigar holder of claim 1, wherein a normal axis of the first opening is at a right angle to a normal axis of the second opening.

5. A cigar holder, comprising:

a tubular receptacle having a sidewall, a first end, and a second end, the first end comprising a first opening such that the tubular receptacle is configured to receive at least a portion of a cigar insertably thereinto via the first opening of the first end, the second end comprising a second opening, the sidewall of the tubular receptacle further defined by a through-hole;

a magnet receptacle fastened to the second end of the tubular receptacle, the magnet receptacle comprising an end cap and a protrusion extending therefrom, the protrusion configured to fit to the second end such that the magnet receptacle is attached to the tubular receptacle proximate the second end, the protrusion and the end cap defining a cavity; and a magnet disposed on the end cap at least partially within the cavity.

6. The cigar holder of claim 5, wherein the second end comprises a first thread and the protrusion comprises a second thread, wherein the protrusion is configured to fit to the second end via a threaded connection comprising the first thread and the second thread.

7. The cigar holder of claim 6, wherein the first thread is disposed about an exterior surface of the tubular receptacle proximate the second end and the second thread is disposed about an interior surface of the protrusion.

8. The cigar holder of claim 6, wherein the first thread is disposed about an interior surface of the tubular receptacle proximate the second end and the second thread is disposed about an exterior surface of the protrusion.

9. The cigar holder of claim 5, wherein the protrusion is configured to be insertably fit into the second end, thereby fitting the protrusion to the second end.

10. The cigar holder of claim 5, wherein the through-hole has a diameter sufficiently large to permit passage of a shaft of a golf tee.

11. The cigar holder of claim 10, wherein the diameter of the through-hole is smaller than a diameter of a head of the golf tee.

12. The cigar holder of claim 5, wherein the through-hole has a diameter sufficiently large to permit passage of a shaft of a piston therethrough.

13. The cigar holder of claim 12, wherein the diameter of the through-hole is smaller than a diameter of a head of the piston.

14. The cigar holder of claim 5, wherein the magnet comprises a hard magnet or a soft magnet.

15. The cigar holder of claim 14, wherein the magnet comprises an aluminum-nickel-cobalt magnet, a samarium cobalt magnet, a ferrite magnet, a neodymium-iron-boron magnet, a neodymium-cobalt magnet, a silicon steel sheet magnet, or a soft core magnet.

16. The cigar holder of claim 5, wherein the magnet has a magnetic strength sufficient to constrain an orientation of the magnet relative to an external object to which the cigar holder is attached via magnetic attraction between the magnet and the external object.

17. The cigar holder of claim 5, wherein a normal axis of the first opening is at a right angle to a normal axis of the second opening.

18. A method of making a cigar holder, comprising:

providing a tubular receptacle having a sidewall, a first end, and a second end, the first end comprising a first opening such that the tubular receptacle is configured to receive at least a portion of a cigar insertably thereinto via the first opening of the first end, the second end comprising a second opening, the sidewall of the tubular receptacle further defined by a through-hole;

providing a magnet receptacle comprising an end cap and a protrusion extending therefrom, the protrusion and the end cap defining a cavity;

providing a magnet;

attaching the magnet to the magnet receptacle such that the magnet is disposed on the end cap at least partially within the cavity; and fastening the magnet receptacle to the second end of the tubular receptacle such that the protrusion is insertably fit into the second opening of the second end.

19. The method of claim 18, wherein the magnet has a magnetic strength sufficient to constrain an orientation of the magnet relative to an external object to which the cigar holder is attached via magnetic attraction between the magnet and the external object.

20. The method of claim 18, wherein the first opening is disposed at a right angle, an obtuse angle, or an acute angle relative to the second opening.

* * * * *